United States Patent [19]

Suzuki et al.

[11] 4,301,855

[45] Nov. 24, 1981

[54] APPARATUS FOR PRODUCING METAL RIBBON

[75] Inventors: Hideo Suzuki, Katsuta; Isao Ikuta, Iwaki; Sadami Tomita, Katsuta; Joo Ishihara, Hitachi, all of Japan

[73] Assignees: Hitachi, Ltd., Research Development Corporation of Japan; Hitachi Metals, Ltd., both of Tokyo, Japan

[21] Appl. No.: 102,557

[22] Filed: Dec. 11, 1979

[30] Foreign Application Priority Data

Jun. 23, 1978 [JP] Japan ..... 53/75356

[51] Int. Cl.[3] ..... B22D 11/06

[52] U.S. Cl. ..... 164/254; 164/415; 164/423

[58] Field of Search ..... 164/61, 64, 66, 82, 164/84, 415, 423, 254

[56] References Cited

U.S. PATENT DOCUMENTS

| | | | |
|---|---|---|---|
| 745,786 | 12/1903 | Cole | 164/423 |
| 4,154,283 | 5/1979 | Ray et al. | 164/423 X |
| 4,184,532 | 1/1980 | Bedell et al. | 164/423 X |

FOREIGN PATENT DOCUMENTS

| | | | |
|---|---|---|---|
| 53-35005 | 9/1978 | Japan | 164/423 |

*Primary Examiner*—Robert D. Baldwin

*Attorney, Agent, or Firm*—Craig and Antonelli

[57] ABSTRACT

An apparatus for producing a metal ribbon has a rotary roll. Molten metal is poured from a heated nozzle onto the outer peripheral surface of the roll to form a solidified metal ribbon on the roll surface. To facilitate easy separation of the metal ribbon from the roll surface, a jet of a non-oxidizing gas is directed to the point of separation of the ribbon from the roll surface. The roll surface just upstream of the metal-pouring nozzle is enclosed by a cover the inside of which is evacuated to assure intimate contact of the poured metal with the roll surface and thus improve cooling of the poured metal. A heater is provided in the cover to heat the roll surface just upstream of the metal-pouring nozzle for thereby removing dew droplets and ambient gases from the roll surface whereby the formation of depressions or recesses in the roll-containing ribbon surface is prevented.

12 Claims, 8 Drawing Figures

FIG. 1
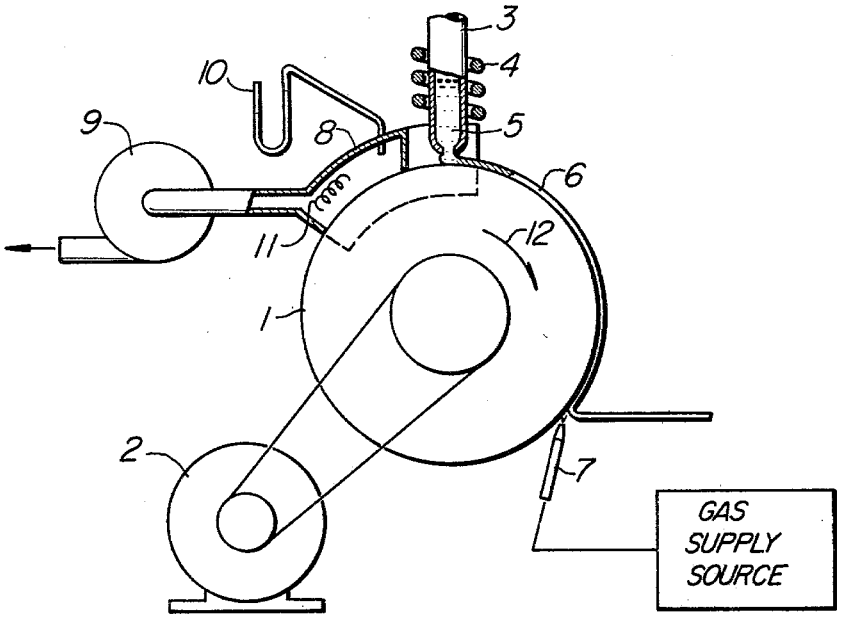
FIG. 2
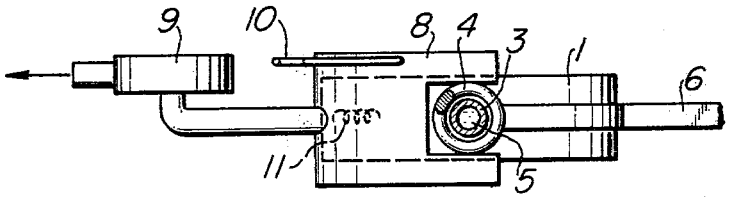
FIG. 3
FIG. 4
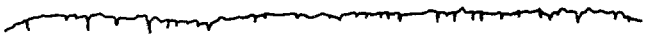

FIG. 5
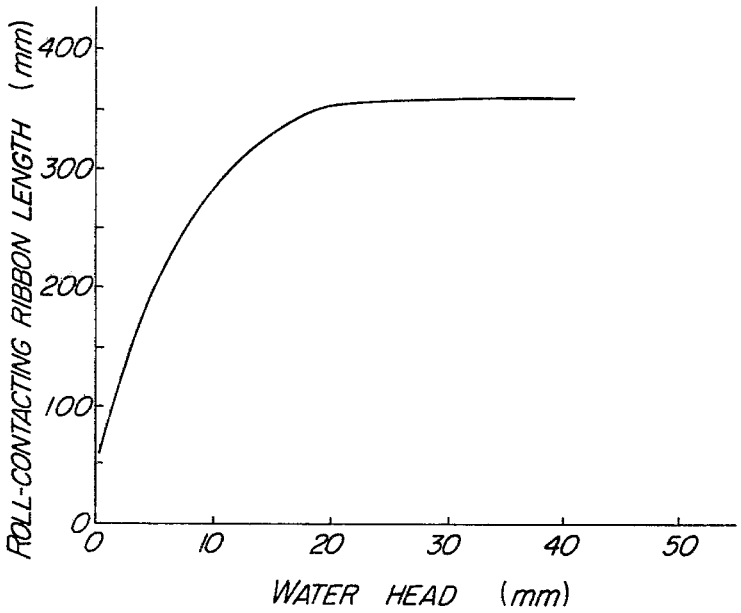
FIG. 6a
FIG. 6b
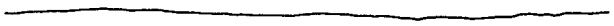
FIG. 6c

APPARATUS FOR PRODUCING METAL RIBBON

BACKGROUND OF THE INVENTION

1. Field of the Invention

The present invention relates to an apparatus for producing a metal ribbon and, more particularly, to an apparatus in which a molten metal is poured onto the surface of a roll rotating at a high speed and is then cooled and solidified to form a metal ribbon.

2. Description of the Prior Art

A method has been known in which a metal ribbon is produced directly from a molten metal by pouring a molten metal onto the surface of a roll rotating at a high speed and then rapidly cooling and solidifying the metal to form the metal ribbon.

The apparatus for carrying out this method includes a rotary roll, means for driving the roll and a nozzle for pouring the molten metal onto the outer peripheral surface of the roll. In some cases, a water-cooled roll is used as the rotary roll.

The molten metal discharged from the nozzle is brought into contact with the outer peripheral surface of the roll and rapidly cooled as a result of heat absorption by the roll and is solidified to form a metal ribbon.

At the beginning of the pouring operation, the temperature of the roll surface is sufficiently low to prevent the metal ribbon from being adhered to the roll surface to thereby permit a smooth separation of the ribbon from the roll surface by the centrifugal force generated as the result of the rotation of the roll. However, as the pouring operation is continued, the temperature of the roll surface is gradually increased with a resultant increase in the adhesion of the metal ribbon to the roll surface. Thus, the circumferential distance over which the metal ribbon adheres to the roll surface, i.e., the circumferential distance from the point where the molten metal is poured onto the roll surface to the point where the ribbon leaves the roll surface, is unduly increased until the ribbon extends entirely around the peripheral surface of the roll, with a result that not only the pouring operation cannot be further continued but also the metal ribbon extending around the roll surface breaks the nozzle and/or injures the outer peripheral surface of the roll.

It is, therefore, one of the important problems to be solved in the field of the metal ribbon production that the metal ribbon be prevented from being wound around the roll surface.

In the metal ribbon production of the class discussed, moreover, the ribbon surface which has been solidified in contact with the roll exhibits a state different from that of the ribbon surface which has been solidified without contact with the roll surface. More specifically, innumerable number of minute recesses or depressions are formed in the ribbon surface which has been solidified in contact with the roll surface, to thereby lower the smoothness of the ribbon surface. The recesses are increased in number towards the leading end of the ribbon and are reduced in number towards the trailing end of the ribbon.

The production of a large number of such recesses or depressions considerably deteriorates the lustre of the metal ribbon. In addition, there would be a possibility that these recesses or depressions formed in a metal ribbon may cause a trouble in the mechanical or electrical components made of the ribbon or lower the physical properties of the components. In order to investigate the influence of the recesses or to the physical properties, the inventors have measured the magnetic flux density, the coercive force and other items of ribbons made of a metal consisting of nickel, boron, silicon and the balance consisting of a ferro-alloy. It has been ascertained that the increase in the number of the recesses formed in ribbon surfaces decreases the magnetic flux density but increases the coercive force. This will mean that the magnetic flux density and the coercive force are varied at or in different portions of the metal ribbon in which the density of the recesses varies along the length of the ribbon. In such a case, it will be impossible to obtain mechanical or electrical components of uniform or homogeneous qualities.

Thus, the second problem to be solved in the art is that the metal ribbon surface solidified in contact with a roll surface be freed from the production of recesses to thereby improve the smoothness of that ribbon surface.

SUMMARY OF THE INVENTION

It is an object of the present invention to provide an apparatus for producing a metal ribbon which is capable of preventing the roll from being wound by the metal ribbon produced.

It is another object of the present invention to provide an apparatus which is capable of producing metal ribbons with improved smoothness of the ribbon surfaces solidified in contact with the roll surface.

It is a further object of the present invention to provide an apparatus which is capable of producing metal ribbons each having a substantially uniform surface smoothness all over the length thereof.

According to the present invention, there is provided an apparatus for producing a metal ribbon, comprising a rotary roll, means for driving the roll and a nozzle through which a molten metal is poured onto the outer peripheral surface of the roll, characterized by means at a preselected position adjacent to the outer peripheral surface of the roll for jetting a gas against the outer peripheral surface of the roll in a direction substantially opposite to the direction of rotation of the roll.

As discussed previously, it becomes difficult to separate or peel the metal strip away from the roll surface as the adhesion between the metal ribbon and the roll surface is increased. According to the apparatus of the present invention, however, the adhesion between the ribbon and the roll surface can conveniently be reduced by directing a jet of the gas from the gas jetting means to the roll surface whereby the solidified metal ribbon can easily be peeled away from the roll surface.

It has also been confirmed that the smoothness of the metal ribbon surface solidified in contact with the roll surface is improved by using, as the above-mentioned gas, a non-oxidizing gas such as argon gas, nitrogen gas and so forth.

In order to know the reason why the smoothness of the metal ribbon surface can be improved, the inventors conducted a test in which a metal ribbon produced without the application of the non-oxidizing gas and the roll used in the production were compared with a metal ribbon produced under application of the non-oxidizing gas and the roll used in the production. The test result showed the following facts:

(i) The outer peripheral surface of the roll is oxidized to form an oxide film or skin in the case where the metal ribbon is produced without the application of the non-oxidizing gas. The surface of the metal ribbon produced by using the roll with the oxide skin thereon is roughened due to a deposit of an oxide film over a part of the roll surface.

(2) The oxide film or skin is hardly formed on the roll surface in the case where the metal ribbon is produced with the application of the non-oxidizing gas jet. The oxide skin is not formed on the ribbon surface either and the smoothness of the metal ribbon surface is considerably improved.

From these facts, it is understood that the improvement in the smoothness of the metal ribbon surface largely depends on the prevention of oxidation of the outer peripheral surface of the roll.

Accordingly, the gas jetted against the outer peripheral surface of the roll is preferably a non-oxidizing gas and, particularly, an inert gas which does not adversely affect the quality of the metal ribbon. By using such a gas, it is possible to simultaneously achieve both of the easy separation of the solidified metal ribbon from the roll surface and the improvement in the smoothness of the metal ribbon surface.

The metal ribbon having a rough surface exhibits mechanical and electric characteristics different from those of the metal ribbon having a smooth surface and also has a poor luster. It is, therefore, desirable to smooth the metal ribbon surface as much as possible. To this end, it is necessary to prevent the formation of the oxide film on the outer surface of the roll. If the formation of the oxide film is unavoidable, it is necessary to remove the same from the roll surface. The removal of the oxide film, however, not only requires an additional step in the process for producing the metal ribbon, but also shortens the operative life of the roll because the roll surface must be cut during the removal of the oxide film. In contrast, to direct a jet of the non-oxidizing gas against the roll surface assures that the additional step for removing the oxide film is completely eliminated or the number of the repetition of such a work is reduced to ensure a longer operative life of the roll.

In order to enhance the prevention of the roll surface oxidation, it is essential to arrange such that the non-oxidizing gas contacts the roll surface over as large an area as possible. It has been found that, in order to effectively prevent the oxidation of the roll surface by the use of the gas which is jetted to facilitate the separation of the metal ribbon, the gas jetting nozzle should preferably be disposed such that the gas is jetted in the direction tangential to the roll.

The smoothness of the roll-contacting surface of the metal ribbon is not satisfactorily achieved solely by the prevention of oxidation of the roll surface. The roll surface still has innumerable depressions and the density of these depressions is increased towards the leading end portion of the metal ribbon.

The inventors have made an investigation to know the factors which roughen the metal ribbon surface solidified in contact with the roll surface, with a result that the following factors have been found to be the causes in addition to the afore-mentioned oxidation of the roll surface:

(I) The rotation of the roll induces flows of an ambient gas such as air adjacent to the outer peripheral surface and axial end surfaces of the roll. When the molten metal from the nozzle is poured and brought into contact with the outer peripheral surface of the roll, the flow of the gas is trapped between the layer of the molten metal and the outer peripheral surface of the roll. The portions of the molten metal in contact with the gas bubbles are recessed to form depressions in the metal ribbon surface.

(II) Moisture and gases in the ambient air are adhered to the roll surface before and immediately after the rotation of the roll is initiated. As the roll surface is heated by the molten metal poured onto the roll, the moisture is evaporated from the roll surface and, at the same time, the gases are freed from the roll surface. The adherence of the moisture and the gases does not take place once the roll has been heated by the molten metal. However, before the vapor and the gases are completely removed from the roll surface, they are trapped between the molten metal layer and the roll surface to form the depressions as in the case of the ambient gas mentioned in the item (I) above. The formation of a large number of depressions in the areas of the ribbon adjacent to the leading end thereof is caused by the moisture and gases adhered to the roll surface.

As a measure to overcome the problem mentioned in the item (I) above, the inventors have thought of providing cover means over the surfaces of the roll adjacent to the point where the molten metal is brought into contact with the roll surface, and means for discharging the ambient gas out of the space in the cover means. It has been confirmed that these cover and discharging means are operative to eliminate the flow of the ambient gas in the vicinity of the molten metal pouring nozzle and to almost completely avoid the afore-mentioned trapping of the atmospheric gas between the molten metal and the roll to remarkably suppress the formation of the depressions in the metal ribbon surface.

In order to overcome the problem (II) stated above, the inventors have worked out the following measure and confirmed the efffectiveness thereof.

More specifically, this measure is to provide means for heating the portion of the outer peripheral surface of the roll which is located immediately upstream of the nozzle for pouring the molten metal. As the outer peripheral surface of the roll is heated by the heating means, the moisture adhered to the roll surface is evaporated to leave the same. The ambient gas clinging to the roll surface is also diffused. Thus, the moisture and the gases are completely removed away from the roll surface. There would be a case where the portion of the roll surface which has passed the position of the heating means be cooled again to permit the deposit of new moisture and gases on the roll surface. Because the heating means is disposed adjacent to the nozzle, however, such a deposition is of a negligible amount and will not be a cause of the production of a large number of depressions in the roll-contacting surface of the metal ribbon.

The heating means may be disposed either inside or outside the aforementioned cover means. However, for obtaining a larger effect of suppression of generation of the depressions, it is preferred to dispose the heating means inside of the cover means for the reasons described below.

As stated before, the cover means is provided to cover the portions of the roll surfaces in the vicinity of the point at which the molten metal is poured onto the roll surface and is located adjacent to the nozzle. Therefore, the circumferential distance between the heating means and the nozzle for pouring the molten metal is conveniently shortened if the heating means is disposed within the cover means. This arrangement ensures that the heated roll surface portion can be brought into contact with the molten metal before the dew drops and the gases attach to the heated roll surface portion, thereby to enhance the effect to prevent the formation of depressions. It is to be also noted that, since the cover means is provided with means for discharging the gases out of the space defined in the cover means, the gases freed from the outer peripheral surface of the roll can be removed out of the cover means. Thus, the discharging means assures that unfavourable staying of the diffused gas around the outer peripheral surface of the roll, which would otherwise cause a trapping of the gases between the molten metal and the roll surface resulting in the problem as stated in item (I) above, is fairly avoided.

When the production of the metal ribbon is conducted while evacuating the area around the nozzle for pouring the molten metal, the molten metal is caused to contact the outer peripheral surface of the roll under vacuumed condition, whereas the free solidification surface, i.e. the surface of the molten metal which is not contacted by the roll, is subjected to the atmospheric pressure after it has passed the position of the nozzle. In consequence, the molten metal is pressed by the atmospheric air against the roll surface and is solidified in this condition. Therefore, the heat of the molten metal is rapidly removed to permit a solidification in a shorter period of time.

The apparatus of the present invention is capable of producing a ribbon directly from a molten metal even if the metal is of the class which is difficult to form into ribbon by ordinary processes. The apparatus of the invention can also be advantageously used in the production of amorphous metal. It is remarkable that, according to the invention, a continuous metal ribbon having a thickness of about 30 μm, a width of about 50 mm and a length of more than 100 m can be produced easily.

Copper, tool steel or tool steel plated with hard chromium can suitably be used as the material of the rotary roll.

BRIEF DESCRIPTION OF THE DRAWINGS

FIG. 1 is a side elevational view of an embodiment of the apparatus according to the present invention;

FIG. 2 is a plan view of the apparatus shown in FIG. 1;

FIG. 3 is a graph showing the smoothness of the roll-contacting surface of a metal ribbon produced by the apparatus shown in FIG. 2;

FIG. 4 is a graph showing the smoothness of the roll-contacting surface of a metal ribbon produced under a different condition of production;

FIG. 5 is a graph showing the relationship between the circumferential length over which the metal ribbon contacts the roll surface and the water head of a monometer mounted on a cover; and FIGS. *6a, 6b* and *6c* are illustrations showing smoothnesses at three different points of the roll contacting surface of a metal ribbon produced by the apparatus of the invention.

DESCRIPTION OF PREFERRED EMBODIMENTS

Embodiment 1

An apparatus for producing a metal ribbon as shown in FIGS. 1 and 2 was manufactured and was used in the production of a metal ribbon of an alloy consisting of 70 at% of iron, 8 at% of nickel, 10 at% of silicon and 12 at% of boron. The apparatus has a rotary roll 1 which is made of a tool steel consisting of 0.35 wt% of carbon, 0.8 wt% of silicon, 0.3 wt% of manganese, 4.8 wt% of chromium, 1.2 wt% of molybdenum, 1.0 wt% of vanadium and the balance consisting of iron. The roll 1 is plated with hard chromium. The roll 1 has a diameter of 300 mm. The width or axial length of the outer peripheral surface of the roll is 40 mm. The plated chromium layer has a thickness of 15 μm. The rotary roll 1 is adapted to be driven by means of a motor 2. A nozzle 3 for pouring a molten metal is disposed above the top of the rotary roll 1. A clearance of 0.15 mm is preserved between the bottom end of the nozzle 3 and the outer peripheral surface of the rotary roll 1. A high-frequency coil 4 is provided around the nozzle 1 to heat the metal contained therein.

The nozzle 3 is adapted to be charged with a metal either in the solid state or in the molten state. In the former case, the high-frequency coil 4 functions to melt the solid material and to maintain the metal in the molten state. In the latter case, the high-frequency coil 4 acts to keep the molten metal at a high temperature to prevent the metal from being solidified. In FIG. 1, the metal 5 in the nozzle 3 is shown in the molten state.

As a pressure is applied to the inside of the nozzle 3, the molten metal 5 is injected from the nozzle onto the outer peripheral surface of the roll 1 and flows in the direction of rotation of the roll 1 shown by an arrow 12 while the metal is solidified to form a metal ribbon 6. A gas jetting nozzle 7 is provided for facilitating the separation of the metal ribbon 6 from the roll surface. More specifically, the gas jetting nozzle 7 is disposed at a point which is spaced from the nozzle 3 by a circumferential distance of $\frac{3}{4}\pi R$ in the direction of rotation of the roll. The gas jetting nozzle 7 is directed substantially in the tangential direction of the roll 1 in order that the jetted gas may be directed not only to the point of separation of the metal ribbon 6 from the roll 1 but also to the portion of the outer peripheral surface of the roll near to said point.

A cover 8 is disposed in the vicinity of the metal-pouring nozzle 3 so as to partially cover the side and peripheral surfaces of the rotary roll 1. A gas discharging means in the form of a pump 9 is provided to discharge the ambient gas out of the cover 8. As will be clearly seen in FIGS. 1 and 2, the cover 8 is arranged such that a part of each of the side surfaces of the roll 1 and a part of the outer peripheral surface of the roll are covered. In the illustrated embodiment of the invention, a U-shaped vacuum gauge or manometer 10 is provided to indicate the degree of the vacuum in the cover 8. The arrangement is such that the degree of the vacuum is known from the reading of the water head difference in the manometer.

The cover 8 accommodates a heater 11 adapted to heat the outer peripheral surface of the roll 1. This heater 11 may be operated only immediately before or after the commencement of rotation of the roll 1 because, after the pouring of the molten metal is commenced, the roll surface is naturally heated to a high temperature by the heat derived from the molten metal in contact with the roll. The heater may be replaced by suitable means for jetting a heating medium such as a heated gas.

The aforementioned metal ribbon made of an alloy consisting of iron, nickel, silicon and boron was produced under the following condition:

Rotational speed of roll 1: 2,000 rpm

Pressure at which molten metal 5 is expelled out of nozzle 3: 0.34 atm.

Temperature of poured molten metal: 1,270° C.

Kind of gas jetted from nozzle 7: nitrogen gas

Pressure of nitrogen gas: 4 atm.

Vacuum within cover 8: 20 mm by water head difference

The heating of the roll 1 by the heater 11 was not conducted in this case.

During the continuous production of the ribbon 6 of amorphous metal, the ribbon 6 was stably separated from the roll 1 at a fixed point illustrated in FIG. 1 and the winding of the ribbon 6 around the roll 1 did not take place at all.

The roughness of the roll-contacting surface of the amorphous metal ribbon 6 was measured by means of a roughness gauge at a point spaced 5 m from the leading end of the ribbon. The result of the measurement is shown in FIG. 3. The mean value of the measured roughness was 0.2 μm.

FIG. 4 shows the roughness at a similar or corresponding point along another amorphous ribbon produced by the apparatus in which the cover 8 and the gas discharging means were not operated. The mean value of the roughness in this case was 1.0 μm.

Embodiment 2

The apparatus of this embodiment is substantially identical to that shown in FIGS. 1 and 2 except that the roll 1 is made of copper. An amorphous metal ribbon was produced by this apparatus from an alloy consisting of 81 at% of iron, 12 at% of boron and 7 at% of carbon. The temperature of the molten metal poured from the nozzle 3 was 1230° C., while the pressure in the nozzle 3 at which the molten metal was forced out from the nozzle was 0.3 atm. The gas jetting nozzle 7 was arranged such that the discharge end thereof is located at a point which is angularly spaced 140° in the direction of the roll rotation from the position of the metal pouring nozzle 3. Nitrogen gas was jetted from the nozzle 7 at a pressure of 7 atm. The vacuum in the cover 8 was varied within the range of from 0 to 40 mm by water head difference.

The circumferential length over which the metal ribbon contacts the outer peripheral surface of the roll (this length will be named "roll-contacting ribbon length" hereinafter) was taken into photographs by a high-speed camera (shutter speed 1/175 S) after the lapse of 0.1 second from the commencement of the pouring of the molten metal. The vacuum level in the cover 8 was varied. As a result, it was confirmed that the roll-contacting ribbon length was increased as the vacuum in the cover 8 was increased.

FIG. 5 is a graph showing the relationship between the roll-contacting ribbon length (axis of ordinate) and the water head difference in the U-tube type vacuum gauge (axis of abscissa). It will be seen in this Figure that the roll-contacting ribbon length, which is as small as 60 to 70 mm when the water head difference is 0 (zero), i.e. when evacuation of the cover is not conducted, is drastically increased as the vacuum in the cover is increased. In fact, the roll-contacting ribbon length amounted to 350 mm when the water head difference was 20 mm. However, the roll-contacting ribbon length was increased a little after the water head difference exceeded 20 mm.

From the foregoing description, it will be seen that, by evacuating the space inside the cover, it is possible to obtain an increased roll-contacting ribbon length and, thus, to enhance the effect of cooling of the metal ribbon, which in turn facilitates the formation of the amorphous structure in the metal ribbon.

Embodiment 3

The apparatus shown in FIGS. 1 and 2 was used to produce an amorphous ribbon from an alloy consisting of 70 at% of iron, 8 at% of nickel, 10 at% of silicon and 2 at% of boron. Before the pouring of the molten metal, the roll surface was heated to 120° C. by the heater 11. Then, the molten metal was poured immediately after the completion of the heating. In this case, a tool steel plated with chromium was used as the material of the rotary roll and the roll was rotated at 3000 rpm. The metal pouring nozzle 3 was charged with argon gas and the molten metal was discharged at a pressure of 1 atm. In addition, nitrogen gas was jetted at a pressure of 2 atm from the gas jetting nozzle 7. Other conditions were substantially the same as those in Embodiment 1.

The undesirable winding of the metal ribbon around the roll was not observed also in this case.

The roughnesses of the roll-contacting surface of the metal ribbon thus produced was measured at three different points on the metal ribbon spaced from the leading end thereof by 1.5 m, 7 m and 15 m, respectively. FIGS. *6a*, *6b* and *6c* are illustrations of the roughnesses of the roll contacting surface of the metal ribbon as measured at points 1.5 m, 7 m and 15 m spaced apart from the leading end of the metal ribbon, respectively. A mean roughness of 0.5 μm was obtained at the point spaced 1.5 m from the leading end of the ribbon, whereas, at the points spaced 7 m and 15 m from the same end, the mean roughness was 0.25 μm. Although there is a slight difference in the surface roughness between the leading end portion and the portion spaced more than 7 m from the leading end of the metal ribbon, this difference does not cause any serious problem and is acceptable. In addition, the roll contacting surface is rather smooth even at the leading end portion of the metal ribbon.

On the other hand, the metal ribbon produced by means of the apparatus in which the cover 8 and the gas discharging means 9 were omitted showed a multiplicity of depressions in the roll contacting surface at the leading end portion thereof, although the metal ribbon was not wound around the roll. The mean roughness at the points spaced 1.5 m, 7 m and 15 m from the leading edge were 8 μm, 2.5 μm and 1.5 μm, respectively.

Table 1 shows the D.C. magnetization characteristics of the metal ribbon produced without heating the roll outer peripheral surface. The characteristics were measured at points adjacent to the points of the measurement of the surface roughness. Table 2 shows the D.C. magnetization characteristics of the metal ribbon produced by heating the roll outer peripheral surface. The characteristics were measured at points adjacent to the points of the measurement of the surface roughness.

TABLE 1

| Distance from leading end | Magnetic flux density ($B_{10}$) | Coercive force (Hc) | Rectangular ratio ($Br/B_{0.5}$) |
|---|---|---|---|
| 1.5 m | 8950G | 106 mOe | 89.4% |
| 7 m | 1070G | 90 mOe | 94.0% |
| 15 m | 11100G | 69 mOe | 95.4% |

TABLE 2

| Distance from leading end | Magnetic flux density ($B_{10}$) | Coercive force (Hc) | Rectangular ratio ($Br/B_{0.5}$) |
|---|---|---|---|
| 1.5 m | 11200G | 66 mOe | 94.2% |
| 7 m | 11600G | 63 mOe | 94.3% |
| 15 m | 12000G | 61 mOe | 96.1% |

From Tables 1 and 2 , it will be seen that the metal ribbons having the same compositions exhibit different magnetic flux densities, coercive forces and rectangular ratio if these metal ribbons have different surface roughnesses.

It is also to be noted that the fluctuation of the magnetization characteristic is greatly decreased if metal ribbons are produced by means of the apparatus having means for heating the outer peripheral surface of the roll and also the combination of the cover 8 and the gas discharging or evacuating means 9, as will be seen from Table 2.

It will be understood from the foregoing description that, according to the invention, it is possible not only to prevent the metal ribbon from being wound around the roll but also to suppress the formation of depressions in the roll-contacting surface of the metal ribbon thereby to ensure a highly improved smoothness of the roll-contacting surface.

What is claimed is:

1. In an apparatus for producing a metal ribbon, comprising rotary roll, means for driving said rotary roll and a nozzle through which a molten metal is poured onto the outer peripheral surface of said rotary roll; the improvement comprising gas jetting means at a preselected position adjacent to the outer peripheral surface of said rotary roll for jetting a gas substantially tangential to said outer peripheral surface in a direction substantially opposite to the direction of rotation of said rotary roll to thereby peel said ribbon away from the roll peripheral surface, said position being disposed at a circumferential distance from the nozzle in the direction of rotation of the roll sufficient to enable the ribbon to be solidified on said rotary roll.

2. An apparatus for producing a metal ribbon as claimed in claim 1, wherein said gas jetting means is arranged to direct said gas in a direction substantially tangential to said outer peripheral surface of said rotary roll.

3. An apparatus for producing a metal ribbon as claimed in claim 1, further including a source of non-oxidizing gas in flow communication with said gas jetting means, whereby said gas jetted by said gas jetting means is a non-oxidizing gas.

4. In an apparatus for producing a metal ribbon, comprising a rotary roll, means for driving said rotary roll and a nozzle through which a molten metal is poured onto the outer peripheral surface of said rotary roll, the improvement comprising: gas jetting means disposed at a preselected position adjacent to the outer peripheral surface of said rotary roll and adapted to jet a gas substantially tangential to said outer peripheral surface in a direction substantially opposite to the direction of rotation of said rotary roll to thereby peel said ribbon away from the roll peripheral surface, said position being disposed at a circumferential distance from the nozzle in the direction of rotation of the roll sufficient to enable the ribbon to be solidified on said rotary roll; cover means covering the surfaces of said rotary roll adjacent to the point at which the molten metal from said nozzle comes into contact with said outer peripheral surface of said rotary roll; and evacuating means adapted to discharge the ambient gas out of said cover means.

5. An apparatus for producing a metal ribbon as claimed in claim 4, wherein said evacuating means includes a gas discharge port, with the gas discharge port of said evacuating means being disposed on the leading side of said metal-pouring nozzle as viewed in the direction of rotation of said rotary roll.

6. In an apparatus for producing a metal ribbon, comprising rotary roll, means for driving said rotary roll and a nozzle through which a molten metal is poured onto the outer peripheral surface of said rotary roll; the improvement comprising: gas jetting means disposed at a preselected position adjacent to the outer peripheral surface of said rotary roll and adapted to jet a gas substantially tangential to said outer peripheral surface in a direction substantially opposite to the direction of rotation of said rotary roll to thereby peel said metal ribbon from the roll peripheral surface, said position being disposed at a circumferential distance from the nozzle in the direction of rotation of the roll sufficient to enable the ribbon to be solidified on said rotary roll; cover means covering the surfaces of said rotary roll adjacent to the point at which the molten metal from said nozzle comes into contact with said outer peripheral surface of said rotary roll; evacuating means adapted to discharge the ambient gas out of said cover means; and heating means adapted to heat the portion of said outer peripheral surface of said rotary roll before said surface portion is moved past the position of said metal-pouring nozzle.

7. An apparatus for producing a metal ribbon as claimed in claim 6, wherein said heating means is disposed within said cover means.

8. An apparatus for producing a metal ribbon as claimed in claim 4 or 6, wherein said cover means covers only a portion of the surfaces of said rotary roll.

9. An apparatus for producing a metal ribbon as claimed in claim 8, wherein said cover means leaves uncovered the surfaces of the rotary roll adjacent the position where the metal ribbon separates from said outer peripheral surface.

10. An apparatus for producing a metal ribbon as claimed in claim 9, wherein said cover means further leaves uncovered the outer peripheral surface of the rotary roll adapted to receive the molten metal from said nozzle.

11. An apparatus for producing a metal ribbon as claimed in claim 4 or 6, wherein said cover means is positioned only in the vicinity of said metal-pouring nozzle such that said cover means covers only portions of the roll surfaces in the vicinity of the point at which the molten metal is poured onto the roll surfaces.

12. An apparatus for producing a metal ribbon as claimed in claim 11, wherein said cover means covers portions of the side and outer peripheral surfaces of the rotary roll.

* * * * *